US006467956B1

(12) United States Patent
Tilman et al.

(10) Patent No.: US 6,467,956 B1
(45) Date of Patent: Oct. 22, 2002

(54) TAMPER EVIDENT PACKAGE HAVING SLIDER DEVICE, AND METHODS

(75) Inventors: Paul A. Tilman, Sherwood; James E. Buchman, Hortonville, both of WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/706,250

(22) Filed: Nov. 3, 2000

Related U.S. Application Data

(60) Provisional application No. 60/194,975, filed on Apr. 5, 2000.

(51) Int. Cl.[7] ..... B65D 33/25

(52) U.S. Cl. ..... 383/61.3; 383/104; 383/204; 383/5

(58) Field of Search ..... 383/61, 64, 5, 383/204, 104, 61.3; 493/213

(56) References Cited

U.S. PATENT DOCUMENTS

| | | | | |
|---|---|---|---|---|
| 3,790,992 | A | | 2/1974 | Herz |
| 4,744,674 | A | | 5/1988 | Nocek |
| 4,786,190 | A | | 11/1988 | Van Erden et al. |
| 4,832,505 | A | | 5/1989 | Ausnit et al. |
| 4,874,257 | A | | 10/1989 | Inagaki |
| 4,923,309 | A | | 5/1990 | VanErden |
| 4,925,316 | A | | 5/1990 | Van Erden et al. |
| 4,944,603 | A | | 7/1990 | Cornish et al. |
| 4,966,470 | A | | 10/1990 | Thompson et al. |
| 5,005,707 | A | | 4/1991 | Hustad et al. |
| 5,121,997 | A | | 6/1992 | La Pierre et al. |
| 5,127,208 | A | | 7/1992 | Custer et al. |
| 5,131,121 | A | | 7/1992 | Herrington, Jr. et al. |
| 5,224,779 | A | | 7/1993 | Thompson et al. |
| 5,456,928 | A | | 10/1995 | Hustad et al. |
| 5,488,807 | A | | 2/1996 | Terrenzio et al. |
| 5,669,715 | A | | 9/1997 | Dobreski et al. |
| 5,713,669 | A | | 2/1998 | Thomas et al. |
| 5,911,508 | A | | 6/1999 | Dobreski et al. |
| 5,924,795 | A | | 7/1999 | Thompson et al. |
| 5,964,532 | A | | 10/1999 | St. Phillips et al. |
| 6,000,197 | A | * | 12/1999 | Ausnit ..... 493/213 X |
| 6,010,244 | A | | 1/2000 | Dobreski et al. |
| 6,131,369 | A | * | 10/2000 | Ausnit ..... 493/213 X |
| 6,212,857 | B1 | * | 4/2001 | Van Erden ..... 493/213 X |
| 6,273,607 | B1 | * | 8/2001 | Buchman ..... 383/64 X |
| 6,287,001 | B1 | * | 9/2001 | Buchman ..... 383/64 |
| 6,290,390 | B1 | * | 9/2001 | Buchman ..... 383/64 X |
| 6,290,391 | B1 | * | 9/2001 | Buchman ..... 383/64 X |
| 6,293,701 | B1 | * | 9/2001 | Tomic ..... 383/64 |
| 6,293,896 | B1 | * | 9/2001 | Buchman ..... 493/213 |
| 6,357,914 | B1 | * | 3/2002 | Kinigakis et al. ..... 24/400 |
| 6,360,513 | B1 | * | 3/2002 | Strand et al. ..... 493/213 |
| 6,364,530 | B1 | * | 4/2002 | Buchman ..... 24/400 |

* cited by examiner

*Primary Examiner*—Jes F. Pascua
(74) *Attorney, Agent, or Firm*—Julie R. Daulton; Tracey D. Beiriger

(57) ABSTRACT

A flexible, reclosable package having a zipper closure and a slider device mounted thereon, the zipper closure and slider device encapsulated within a tamper evident-structure such as a hood. The hood has a top seal region where the walls of the hood are sealed together; the hood walls can be of the same material as the package walls. In one embodiment, each end of the zipper closure includes an area that terminates the slider device travel; this can be a crush area or region. In order to gain access to the interior of the package, the hood is removed by breaching the hood, such as at an area of weakness that is between the slider device and the region where the zipper closure attaches to the package walls.

9 Claims, 8 Drawing Sheets

TAMPER EVIDENT PACKAGE HAVING SLIDER DEVICE, AND METHODS

Priority under 35 U.S.C. § 119(e) is claimed to provisional application Ser. No. 60/194,975, filed on Apr. 5, 2000, and entitled "Tamper Evident Package Having Slider Device, and Methods". The complete disclosure of application Ser. No. 60/194,975 is incorporated by reference herein.

BACKGROUND

This disclosure relates to reclosable packages having a zipper closure mechanism and a slider device for facilitating opening and closing the zipper closure mechanism. More specifically, the reclosable packages include a tamper-evident structure.

Flexible packages, in particular resealable and recloseable packages, are frequently used for packaging of consumable goods. Goods that are not used completely when the package is initially opened rely on a zipper closure to reclose the package and keep the remaining contents fresh. Examples of consumable goods that are often provided in packages, such as bags, with a zipper closure include potting soil, fertilizer, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY

The present disclosure is directed to a flexible, reclosable package that has a tamper evident-structure positioned over and encasing the zipper closure and slider device; the tamper evident-structure provides indication whether an attempt to gain access to the package interior has occurred. This disclosure also is directed to methods of making packages and methods of opening packages.

In particular, one embodiment of the disclosure is directed to a reclosable package having a surrounding wall defining an interior, a bottom portion, and a mouth opposite the bottom portion. The mouth has an open position and a closed position, and provides access to the interior when the mouth is in the open position. The surrounding wall includes first and second, opposite panel sections that are joined at first and second side edges. These panel sections define an integral hood construction, which includes a top seal region at an end of the package opposite the bottom portion. This top seal region is formed by the first and second panel sections being sealed along their respective edge portions. The package further has a zipper closure extending along the mouth. The zipper closure include first and second releasably interlocking closure profiles that are connected to the first and second panel sections at first and second bonding regions. The hood construction is a tamper evident-structure in covering relation to the mouth and zipper closure of the package. Further, a slider device is operably mounted on the zipper closure to interlock the first closure profile with the second closure profile when the slider device is moved in a first direction, and to disengage the first closure profile from the second closure profile when the slider device is moved in a second opposite direction; the slider device also is covered by the hood construction. An area of weakness in the hood construction can provide for selective removal of the hood construction from the first and second panel sections to expose the slider device and the zipper closure.

Another embodiment of the present disclosure is directed to a method of opening and using a package having surrounding wall formed by first and second panel sections and defining an interior, a zipper closure defining a mouth having an open position and a closed position, the zipper closure having a slider device operably mounted on first and second closure profiles, and a hood construction integral with the first and second panel sections, the hood covering the zipper closure and the slider device, and including an area of weakness positioned below the slider device. The method of opening this package includes penetrating are removing the hood from the surrounding wall; and exposing the slider device and the zipper closure. The penetrating of the hood can be done by breaching the hood at the area of weakness. The exposed slider device is moved along the zipper closure to unmate the closure profiles, and thus, open the mouth of the package to gain access to the package interior.

In another embodiment of the disclosure, a package is made. This can be done by providing a surrounding wall having an interior surface, attaching a zipper closure to the interior surface of the surrounding wall, mounting a slider device onto the zipper closure, sealing the surrounding wall to form first and second side edges approximately perpendicular to the zipper closure, and forming a hood over the zipper closure and the slider device by sealing the surrounding wall above the zipper closure and the slider device. An area of weakness can be provided within the hood to facilitate penetrating the hood. The area of weakness can be positioned below the zipper closure.

DETAILED DESCRIPTION

Figure 1:
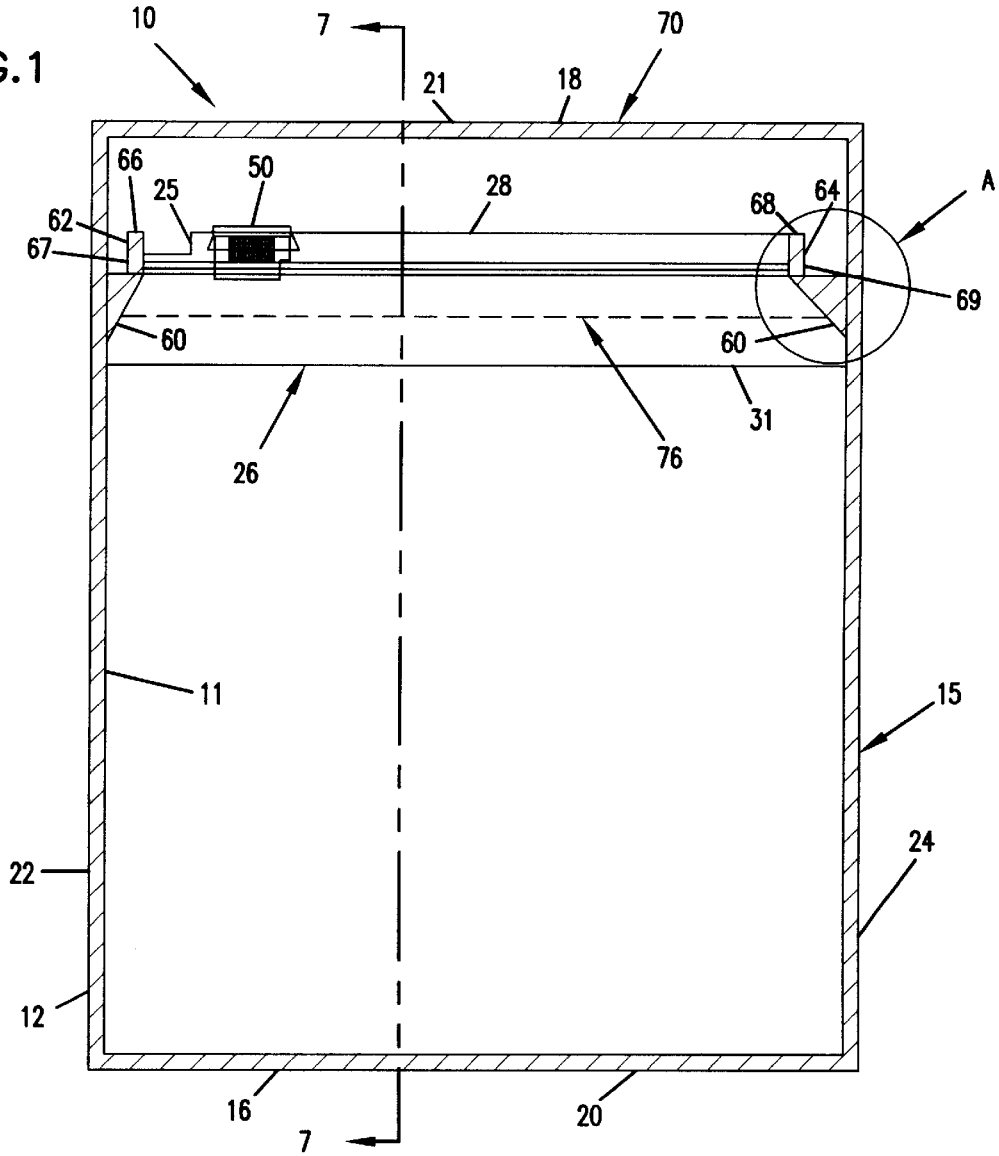
FIG. 1 is a schematic front plan view of a first embodiment of a reclosable package having a zipper closure and a slider device.
Figure 7:
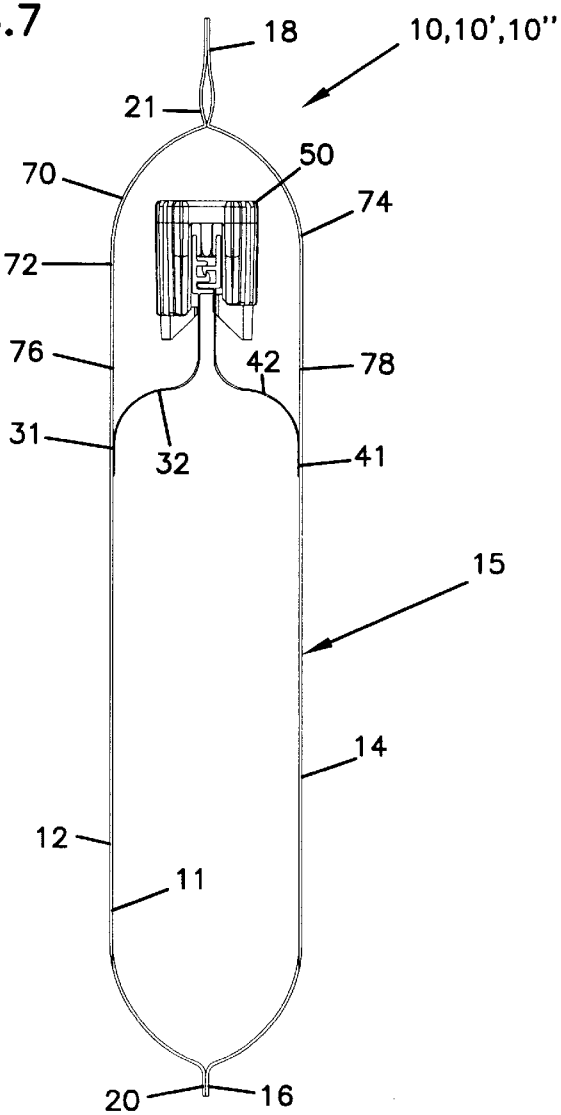
FIG. 7 is a cross-sectional view of the package taken along line 7—7 of any of FIGS. 1, 5 and 6.

As can be seen in FIGS. 1 and 7, package 10 has a surrounding wall formed by a pair of opposing panel sections 12, 14 (FIG. 7) of material sealed along both a bottom 16 and top 18 of the package 10. The terms "top" and "bottom" are relative terms used in respect to package 10 as shown in FIGS. 1 and 7. It is understood that package 10 can be oriented in different directions, so that, for example, top 18 would not be at the top most portion of the figure but would be positioned else where. However, no matter in what orientation package 10 is, top 18 is the edge of package 10 closest to mouth 28 and most distant from bottom 16.

The top 18 of package 10 has a top flange seal 21, which can formed by the application of heat and pressure to the panel sections; this seal is typically made with a seal bar. The bottom 16 of the package can also include a seal 20 formed by the application of heat and pressure. In some embodiments, bottom 16 may be a fold between panel sections 12, 14. FIG. 1 shows side edges 22, 24, which extend between the bottom 16 and top 18 of the package 10. Together, panel sections 12, 14, side edges 22, 24, and bottom 16 define an interior 11, access to which can be gained via mouth 28. Preferably, there are no holes, vents or other features, other than mouth 28, that would provide gasflow communication between the package interior 11 and the outside of package 10.

Below the top flange seal 21, there is a zipper closure 26 having mating closure profiles to open and close (unseal and reseal) panel sections 12, 14; zipper closure 26 extends at least partially between side edge 22 and side edge 24. Specifically, zipper closure 26 extends between a first slider stop 66 and a second slider stop 68, as will be described later. A slider device 50 is mounted on zipper closure 26 to facilitate opening and closing of zipper closure 26. In particular, slider device 50 engages and disengages first and second closure profiles 30, 40, as will be described with reference to FIG. 2.

The resealable zipper closure 26 can be one of a variety of closure mechanisms. In the particular embodiment illustrated in FIG. 2, the resealable zipper closure 26 is shown in the specific form of a zipper-type closure mechanism. By the term "zipper-type closure mechanism," it is meant a structure having opposite interlocking or mating profiled elements that, under the application of pressure, will interlock and close the region between the profiles. Preferably, the zipper-type closure mechanism is not a rolling action type zipper. That is, preferably the closure is not one that closes by a rolling movement from a 6 o'clock position to a 12 o'clock position. It is noted, however, that slider devices 50 of the types described herein are usable with rolling action type zippers. Preferred zipper-type closure mechanisms described herein close by movement from a 9 o'clock to a 3 o'clock position.

Figure 2:
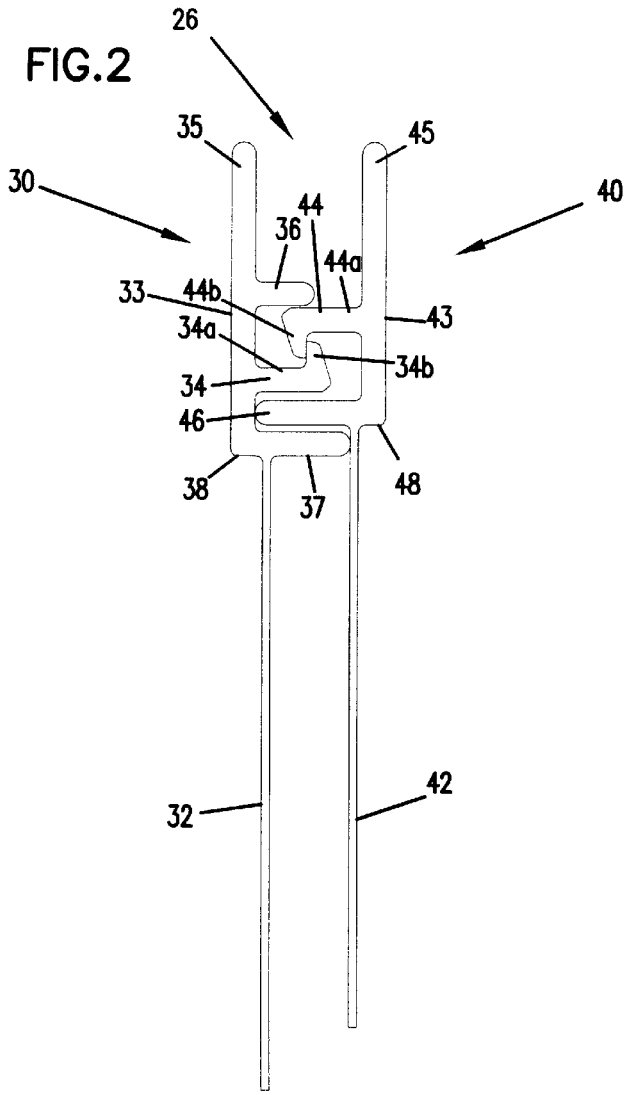
FIG. 2 is an enlarged cross-sectional view of the zipper closure of the package of FIG. 1.

The zipper-type closure mechanism in FIG. 2 is an illustration of one example of a zipper closure 26. The zipper closure 26 includes an elongated first closure profile 30 and an elongated second closure profile 40. Typically, the closure profiles 30, 40 are manufactured separately from each other, although in some embodiments, first and second closure profiles 30, 40 may be manufactured as a single piece, and then slit or otherwise separated prior to incorporation into a package.

The preferred first closure profile 30 depicted includes a sealing flange or bonding strip 32, a base strip 33, a first mating closure member 34, first and second guide posts 36, 37, and an upper or distal flange 35. The mating closure member 34 extends from the base strip 33 by way of a stem 34*a* and is generally projecting from the base strip 33. At a free end of the stem 34*a* (the tip of the closure member 34) is a hook or catch 34*b*. The guide posts 36, 37 also extend from the base strip 33 and are generally projecting from the base strip 33. The guide posts 36, 37 aid in holding the zipper closure 26 closed and in aligning the first closure profile 30 with the second closure profile 40 for interlocking. The sealing flange 32 depends or extends downward from the second guide post 37 and can be attached to a first panel section, such as the first panel section 12 of the package 10 of FIG. 1 at region 31 (FIG. 1). A first shoulder 38 is defined by the intersection of the base strip 33 and bonding strip 32. In the example illustrated, the sealing flange 32 is spaced a distance laterally from the base strip 33 to define a corner forming the shoulder 38. The upper flange 35 extends upwardly from the base strip 33 and first guide post 36.

The preferred second closure profile 40 depicted includes a sealing flange or bonding strip 42, a base strip 43, a second mating closure member 44, a guide post 46, and an upper or distal flange 45. The mating closure member 44 extends from the base strip 43 by way of a stem 44*a* and is generally projecting from the base strip 43. At a free end of the stem 44*a*, (or tip of the closure member 44), is a hook or catch 44*b*. The guide post 46 also extends from the base strip 43 and is generally projecting from the base strip 43. The guide post 46 aids in holding the zipper closure 26 closed and aids in aligning the second closure profile 40 with the first closure profile 30 for interlocking. The sealing flange 42 depends or extends downward from the guide post 46 and can be attached to a second panel section, such as second panel section 14 of the package 10 of FIG. 1. A shoulder 48, analogous to the shoulder 38 of the first closure profile 30, is formed at the corner of sealing flange 42 and guide post 46.

The first and second closure profiles 30, 40 engage and disengage with one another to close and open resealable zipper closure 26. The first mating closure member 34 of the first closure profile 30 extends from the base strip 33 a first distance. The second mating closure member 44 of the second closure profile 40 extends from the base strip 43 a second distance; the second distance may be the same or different than the first distance. These distances that the mating closure members 34, 44 extend are sufficient to allow mechanical engagement, or interlocking, between the first mating closure member 34 of the first closure profile 30 and the second mating closure member 44 of the second closure profile 40. In particular, the catches 34*b*, 44*b* hook or engage each other.

As pressure is applied to the closure profiles 30, 40, they engage to seal zipper closure 26. Pulling the first closure profile 30 and the second closure profile 40 away from each other causes the two closure profiles 30, 40 to disengage, opening the package 10 of FIG. 1. This provides access to the contents of the package 10 through the mouth 28; there should be no holes, vents, or other structures in closure profiles 30, 40, in particular in sealing flanges 32, 42, that would allow access to interior 11, other than through mouth 28.

As stated, slider device 50 is mounted on zipper closure 26 to facilitate opening and closing of zipper closure 26;

specifically, slider device 50 engages and disengages first and second closure profiles 30, 40. Slider device 50 is retained on closure profiles 30, 40 by latching onto shoulders 38, 48, as will be described below.

In general, the slider device 50 includes a housing 52 for slidably engaging the zipper closure 26. As the housing 52 is moved along the zipper closure 26, the zipper closure 26 is engaged and disengaged, to close and open mouth 28 (FIG. 1) of package 10. FIG. 1 illustrates the resealable package 10 in a closed position.

Figure 3:
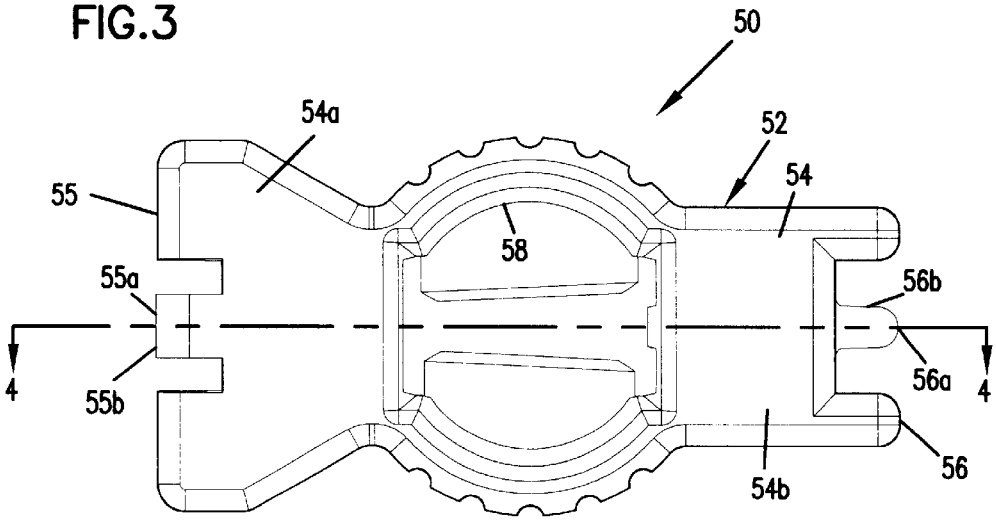
FIG. 3 is an enlarged top plan view of the slider device of the package of FIG. 1.
Figure 4:
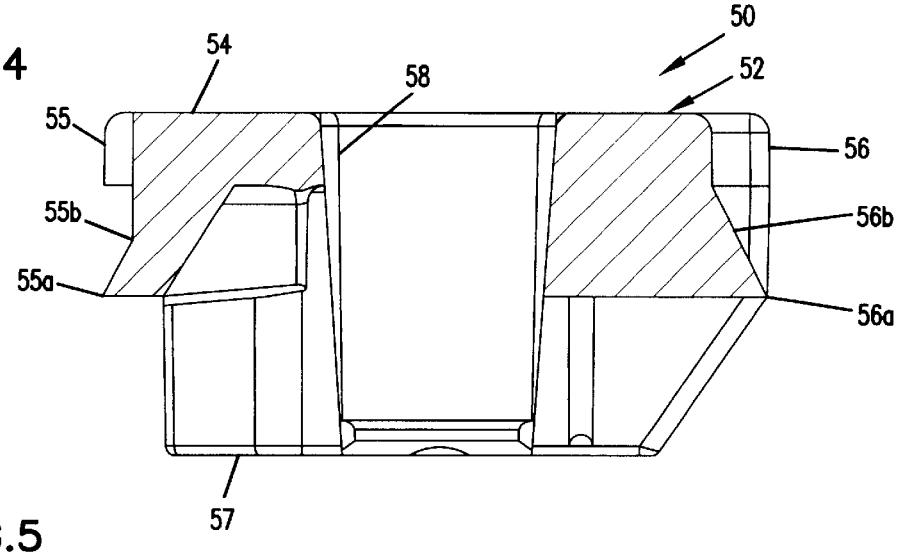
FIG. 4 is a cross-sectional view of the slider device taken along line 4—4 of FIG. 3.

One preferred slider device 50, illustrated in FIGS. 3 and 4, is a one-piece unitary, molded plastic member with no moveable parts that are moveable with respect to one another. Housing 52 is preferably a multi-sided container configured for engaging or locking onto or over the resealable zipper closure 26, typically by engaging with shoulders 38, 48 (FIG. 2) of closure profiles 30, 40. In the particular embodiment illustrated in FIGS. 3 and 4, the housing 52 includes a top wall 54. By the term "top", it is meant that in the orientation of the slider device 50 shown in FIG. 1, the wall 54 is oriented above the remaining portions of the housing 52. It should be understood, of course, that if the housing 52 is moved from the orientation shown in FIG. 1, the top wall 54 may not be in a top orientation. Opposite top wall 54 of housing 52 is bottommost portion 57 of housing 52. The top wall 54 defines a first end 55 and an opposite second end 56. The top wall 54 also defines an open aperture 58. The open aperture 58 divides the top wall 54 between a first portion 54*a* and a second portion 54*b*. The first portion 54*a* generally comprises a flat, planar portion in extension from a periphery of the open aperture 58 to the edge defined by the first end 55. Similarly, the second portion 54*b* generally comprises a flat, planar portion in extension from a periphery of the open aperture 58 to the edge defined by the second end 56. The aperture 58 aids in providing a structure that may be more easily injection molded.

Each end 55, 56 has a bumper 55*b*, 56*b*, which is a portion of housing 52 below top wall 54 that extends from housing 52 to first and second ends 55, 56. Each bumper 55*b*, 56*b* has a tip 55*a*, 56*a* that is the outermost portion of housing 52 at each end 55, 56 of slider device 50. In some embodiments, other portions of housing 52 may extend out the same amount as tips 55*a*, 56*a*; however, no other portion of housing 52 extends past tips 55*a*, 56*a*.

The slider device 50 includes a separation structure for separating the first and second closure profiles 30, 40 (FIG. 2). That is, when the resealable zipper closure 26 is in a closed state such that the mating closure members 34, 44 are interlocked, the separation structure will apply a force to wedge open and pull the closure members 34, 44 apart from each other. This separation structure can extend or depend from the top wall 54 of housing 52. Angled wedges are one example of a separation structure that can be used.

A preferred slider device is taught in U.S. patent application Ser. Nos. 09/365,215 and 29/108,657, both filed Jul. 30, 1999 and incorporated herein by reference in their entirety.

Referring again to FIG. 1, the first and second closure profiles 30, 40 (FIG. 2) are sealed to the respective panel sections 12, 14 (panel section 14 shown in FIG. 7) along the width of panel sections 12, 14 and at the end portions of the zipper closure 26. By "end portions", it is meant the portions of the closure profiles 30, 40 that are adjacent to the respective side edges 22, 24 of package 10. In FIG. 1, these end portions are a funnel or angle seal 60. In FIG. 1, and shown enlarged in FIGS. 1A and 1B, zipper closure 26 terminates short of the side edges 22, 24 of package 10. Specifically, zipper closure 26 ends at profile end 62 proximate first side edge 22 and at profile end 64 proximate second side edge 24. As can be seen, profile ends 62, 64 are positioned interior to side edges 22, 24.

In package 10 of FIG. 1, the sealing flanges 32, 42 (FIG. 2) of each of the profiles 30, 40 are heat sealed in a tapered or triangular configuration to the respective panel sections 12, 14 to create the angle seal 60 in close proximity to each profile end 62, 64. This tapered or funnel-like configuration may facilitate the removal of product from package 10 by providing a easy-pour surface. As illustrated in FIG. 1, angle seal 60 encompasses sealing flanges 32, 42, and optionally, a small portion of panel sections 12, 14. Angle seal 60 is preferably made by the application of heat and pressure to the sealing flanges 32, 42 and panel sections 12, 14; ultrasonics may alternately, or additionally, be used to make angle seal 60.

At each end 62, 64, at least a portion of the mating closure profiles 30, 40 are sealed to provide slider stop regions 66, 68, which retain the slider device 50 on the zipper closure 26 and minimize any tendency for slider device 50 to travel past ends 62, 64. The portions of closure profiles 30, 40 that are sealed can include upper flanges 35, 45, bases 33, 43, guide posts 36, 37, 46, or any other elements of the closure profiles 30, 40. The slider stop regions 66, 68 are typically ultrasonically welded or otherwise crushed. The crushing results in a mass of plastic (polymeric) material melted together to provide crushed stop areas 67, 69. These crush areas 67, 69 are preferably at the ends 62, 64 of zipper closure 26, and can be adjacent seal 60; typically, the crush areas 67, 69 are connected to seal 60.

Figure 1A:
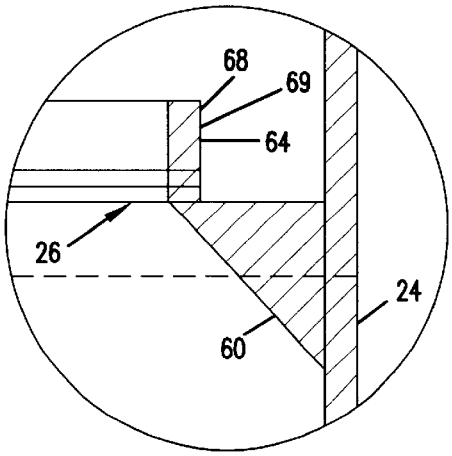
FIG. 1A is an enlarged view of a portion of the reclosable package of FIG. 1 designated at "A"
Figure 1B:
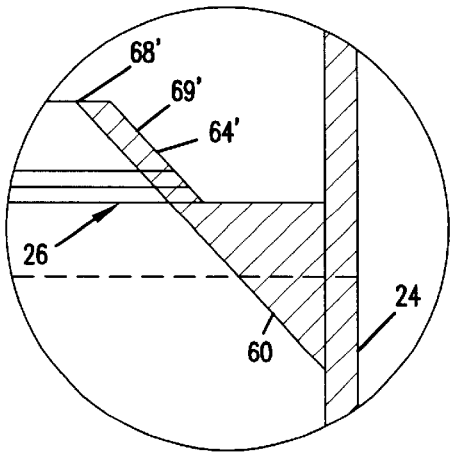
FIG. 1B is an enlarged view of a second embodiment of a portion of the reclosable package of FIG. 1 designated at "A"

Two various embodiments of slider stop region 68, at second side edge 24, are shown in FIGS. 1A and 1B. In FIG. 1A, zipper closure 26 extends to end 64 and slider stop region 68, and crushed stop area 69 are generally parallel to side edge 24. Slider stop region 68 and crushed stop area 69 are generally perpendicular to zipper closure 26. In FIG. 1B, zipper closure 26 terminates at end 64', with slider stop region 68', and crushed stop area 69' being angled to side edge 24. In the embodiment shown, slider stop region 68' and crushed stop area 69' generally follow the same angled funnel as angle seal 60.

Referring again to FIG. 1, slider device 50 is trapped in a path on zipper closure 26 between the opposite end crush areas 67, 69 due to the converging sidewalls of the interlocking mating profiles 30, 40 adjacent to the end crush area 67, 69. In other words, the converging sidewalls immediately adjacent to the end crush areas 67, 69 stop motion of slider device 50 and prevent slider device 50 from engaging either of side edges 22, 24 as well as any deformed portions of the end crush areas 67, 69 that may protrude above or from the side of zipper closure 26. If there is contact between the slider device 50 and the end crush areas 67, 69, it is through engagement of slider bumpers 55*b*, 56*b*, specifically bumper tips 55*a*, 56*a*, at a location inside of the package well below the top 18 of the package 10. Each of the respective end crush areas 67, 69 is located well inboard of the package side edges 22, 24, due in part, to angle seal 60.

Crush areas 67, 69 may facilitate manufacturing of the packages, by providing a thinner area of polymeric material to be sealed to panel sections 12, 14, thus potentially increasing the speed of the manufacturing of the packages. Further, crush areas 67, 69 improve the aesthetic qualities of package 10; the large amount of polymeric material of the closure profiles 30, 40 is distributed throughout the crush areas 67, 69, thereby minimizing large bumps of melting material.

Figure 5:
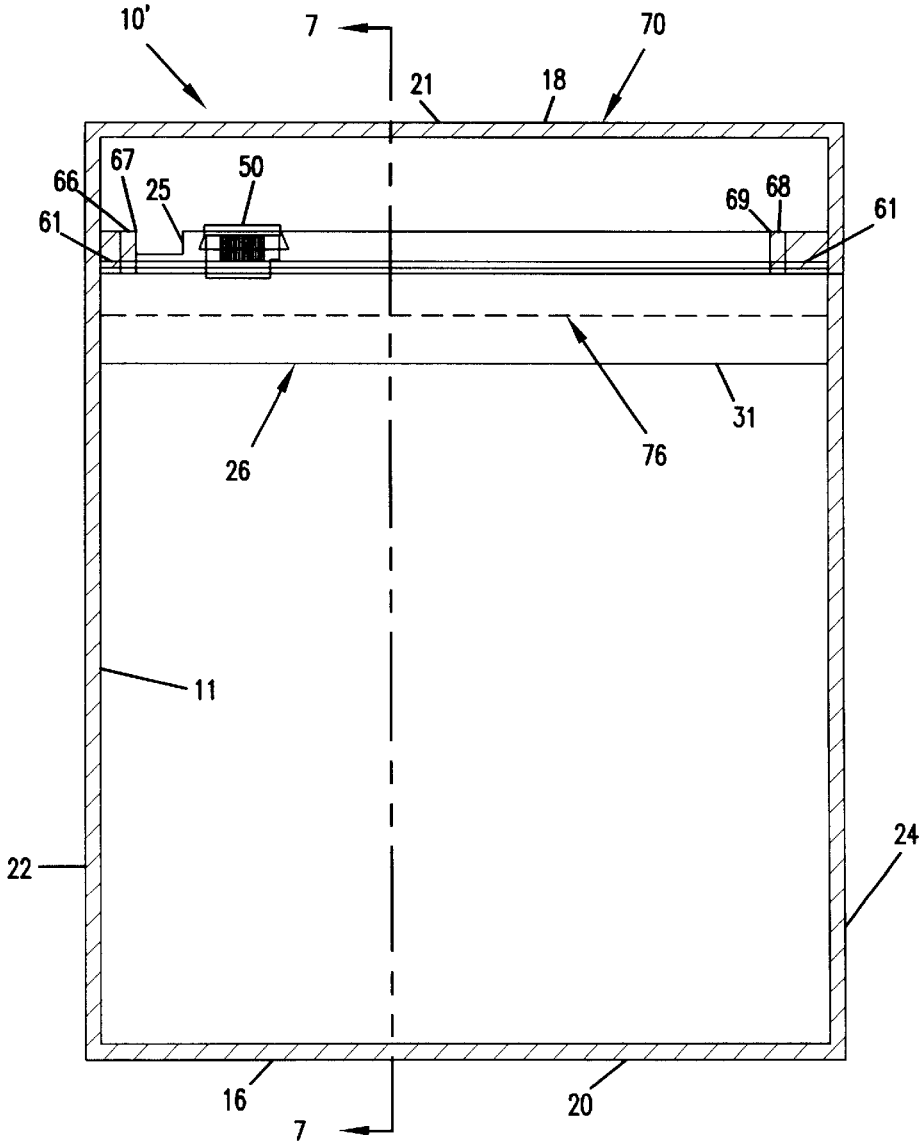
FIG. 5 is a schematic front plan view of a second embodiment of a reclosable package.
Figure 6:
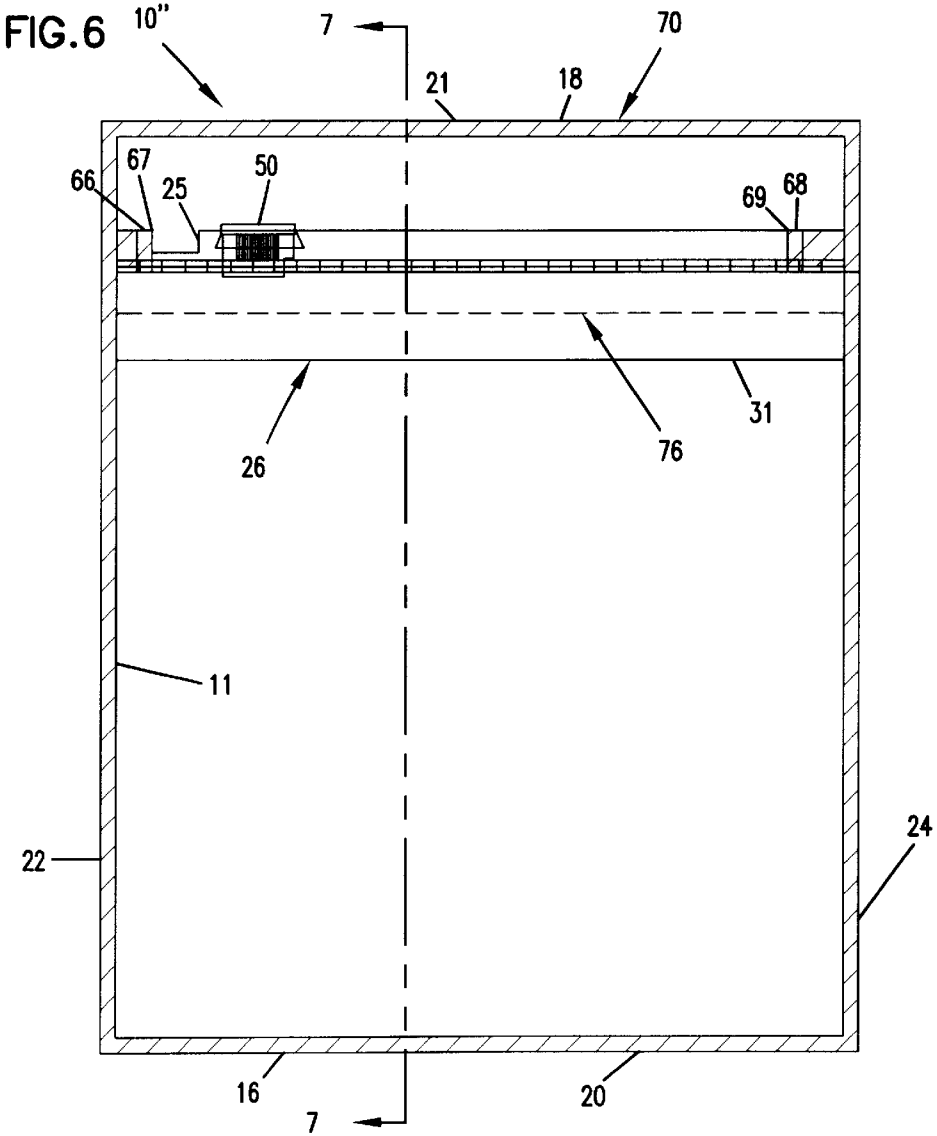
FIG. 6 is a schematic front plan view of a third embodiment of a reclosable package.

FIGS. 5 and 6 show alternate embodiments of package 10; specifically, FIG. 5 illustrates package 10' and FIG. 6 illustrates 10". Packages 10' and 10" differ from package 10 of FIG. 1 at the "end points" of the mating closure profiles 30, 40 that are adjacent to the respective side edges 22, 24 of the packages. Specifically, the packages differ according to the various embodiments of seals and end crush areas that are located at profile ends 62, 64.

In package 10' of FIG. 5, the angle seal is eliminated. Instead, a longitudinal seal 61 is provided that seals closure profiles 30, 40 together. As with package 10 of FIG. 1, end crush areas 67, 69 prevent the slider device 50 from engaging the side edges 22, 24 of package 10'. Crush areas 67, 69 are spaced from side edge 22, 24; this spacing may be any measurable distance, and is typically at least about 1 mm. Similarly, in package 10" of FIG. 6, the angle seal is eliminated. However, in package 10", crush areas 67, 69 extend from profile ends 62, 64 to side edges 22, 24. The crush areas 67, 69 are immediately adjacent side edges 22, 24; that is, the crush areas 67, 69 are continuous to and contiguous with edges 22, 24. Again, crush areas 67, 69 prevent the slider device 50 from engaging the side edges 22, 24 of package 10".

FIG. 7 illustrates a cross section of the package shown in any of FIGS. 1, 5, and 6; specifically, the cross-section shown in FIG. 7 can be the cross-section of any of packages 10, 10', 10". This view of the package shows various features of the packages that may not have been illustrated in FIGS. 1, 5 or 6. For example, both panel sections 12, 14 are shown, attached to sealing flanges 32, 42 at bonding regions 31, 41. Bonding regions 31, 41 are the connection of sealing flanges 32, 42 of closure profiles 30, 40 and panel sections 12, 14. In some embodiments, sealing flanges 32, 42 may be integral with panel sections 12, 14 at the connection; this can be accomplished by co-extrusion of the panel sections 12, 14 with the closure profiles 30, 40. In most embodiments, sealing flanges 32, 42 are heat sealed to panel sections 12, 14 by the application of heat and pressure.

Referring to any of FIGS. 1, 5, 6, and 7, package 10, 10', 10" has a tamper evident-structure disposed at the top 18 of the package. Preferably, the tamper evident-structure is a film, membrane, or other structure disposed over and encasing zipper closure 26 and slider device 50. The tamper evident-structure provides an envelope within which zipper closure 26 and slider device 50 reside; the tamper evident-structure is in covering relation with zipper closure 26 and slider device 50. By the terms "disposed over", "covered", "encased", "covering relation", and other similar terms, it is meant that the tamper evident-structure is positioned over the zipper closure 26 and slider device 50 so that access cannot be gained to the zipper closure and slider device. By "tamper-evident", it is meant that it provides an indication to the consumer as to whether the package has been previously opened. In order to access the interior 11 of the package, the tamper-evident structure needs to be penetrated, breached or otherwise at least partially destroyed or removed.

In the embodiments of FIGS. 1, 5, 6, and 7, the tamper evident-structure is a hood-type structure 70 that is removable from the portion of the package that defines product-containment section 15. Referring to FIG. 7, the hood 70 has first and second opposing walls 72, 74; these walls 72, 74 are integral with panel sections 12, 14, respectively. By the use of the term "integral" it is meant that first panel section 12 and first hood wall 72 are a single unit, such as a continuous sheet or web, preferably a single sheet or web; similarly, second panel section 14 and second hood wall 74 are a single unit, such as a continuous sheet or web, preferably a single sheet or web.

Each of the hood walls 72, 74 has an area of weakness 76, 78 such as a perforation, score line, tear-strip, laser score or other weakened area that is used to help facilitate the removal of the hood 70. These areas 76, 78 allow for selective removal of hood 70 along areas of weakness 76, 78. Hood 70 can be removed from the product-containing section 15 of the package when desired. First area of weakness 76 is also depicted in FIGS. 1, 5 and 6. In FIG. 7, it can be seen that each of the areas of weakness 76, 78 is located closely spaced to the profile bonding region 31, 41 on the consumer side of the package (which also corresponds to the hood 70), as opposed to the product-containing section 15 of the package. Also, note that each of the areas of weakness 76, 78 is located below both the slider device 50 and the mating closure members 34, 44. In some embodiments, it may be desired to remove hood 70 by using an external mechanism, such as scissors, a knife, a razor blade and the like. In such embodiments, hood 70 may not include areas of weakness 76, 78.

Figure 8:
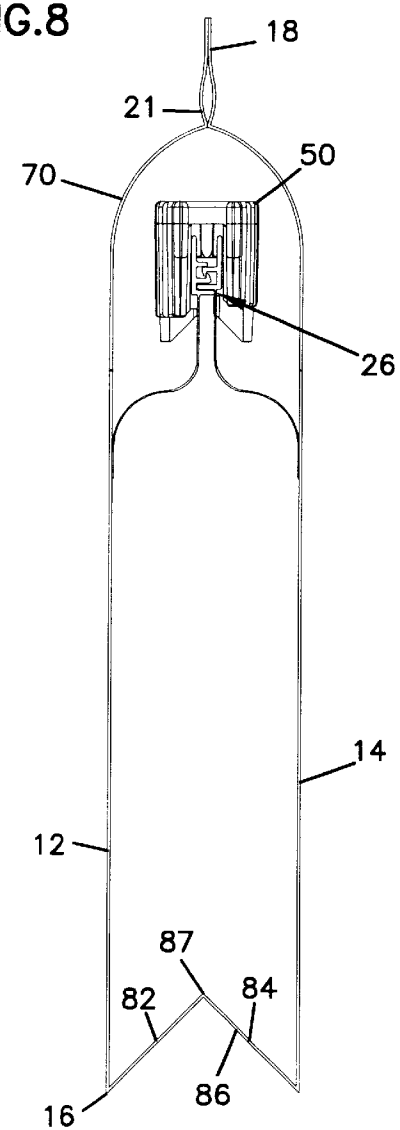
FIG. 8 is a cross-sectional view of an alternate embodiment of a reclosable package, the cross-section being taken along a line analogous to line 7—7 of any of FIGS. 1, 5 and 6.

An alternate package construction is illustrated in FIG. 8. Package 80 of FIG. 8 is similar to any of packages 10, 10', 10" of FIGS. 1, 5 and 6, with a hood 70 encasing zipper closure 26 and slider device 50, except that package 80 has a bottom 16 that includes a gusset 86. Gussets are known for providing packages with "stand-up" features. Gusset 86 of package 80 has first and second gusset sections 82, 84, which are essentially equal in length.

Preferably, each of the first and second gusset sections 82, 84 is made from the same piece of material as the first and second panel sections 12, 14, respectively. Typically when making gusset 86, a single piece of film is folded to form the opposing panel sections 12, 14. Along the fold line between the first and second panel sections 12, 14, a fold 87 is formed, which results in the first and second gusset sections 82, 84 with the fold line 87 in between. Eventually, heat is applied to form the side edges 22, 24 (FIGS. 1, 5 and 6). The side edges 22, 24 will form a seal between all four layers of the package along each respective gusseted side edge of the package.

Referring again to FIG. 7, after hood 70 is removed along each of the areas of weakness 76, 78, the structure that remains is a package where the slider device 50 can move above any remaining sidewall remnants that may remain below the areas where hood 70 was torn or separated. Slider device 50 does not engage or contact side edges 22, 24 of the package because of crush areas 67, 69.

Figure 9:
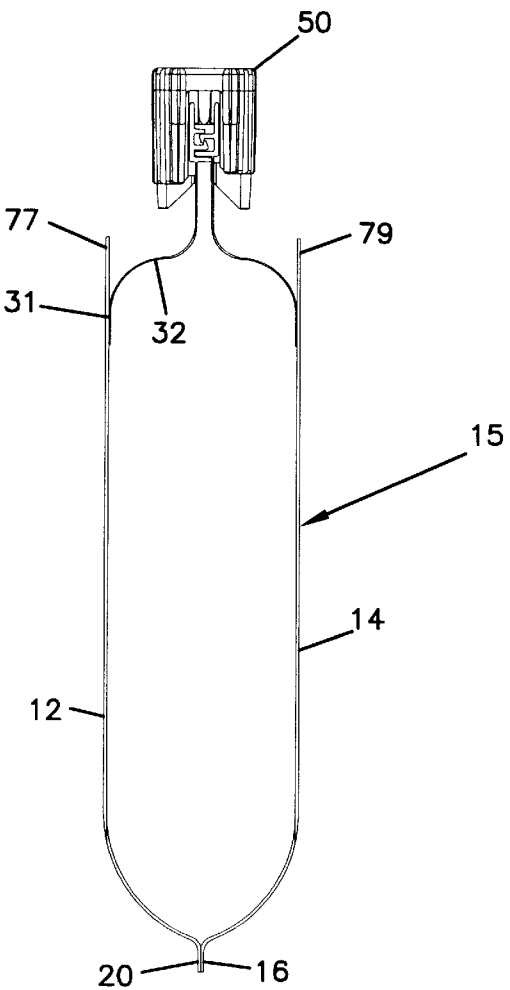
FIG. 9 is a cross-sectional view of the package of FIG. 7 with the tamper-evident structure removed.

FIG. 9 represents a cross-section of what the package construction would appear after the hood 70 (FIG. 7) is removed from the product-containment section 15. As can be seen in FIG. 9, there is a small fragment of material at 77, 79 that remains between each of the areas of weakness 76, 78 (FIG. 7) and the respective profile bonding regions 31, 41. After the hood 70 (FIG. 7) is removed, the slider device 50 is exposed to permit operation by the user to open and close the zipper closure 26. Note that the fragments 77, 79 are short enough in length that they do not interfere in any manner with the operation of the slider device 50 on zipper closure 26. The fragments 77, 79 end at a point that is well below the bottommost package-engaging portion 57 of the slider device 50. Among other things, this means that when the slider device 50 is operated to open and close the zipper closure 26, the fragments 77, 79 in no manner engage the slider device 50 to hinder, prevent or stop motion of the slider device 50.

It can also be seen that below the zipper closure 26, there is no additional closure structure. That is, there is no peel seal, membrane, or web of any type introducing a barrier between the zipper closure 26 and the product-containing section 15 of the bag. The elimination of a second closure structure, such as a peel seal or the like, improves the easy of manufacturing the package by not having the second closure structure. Additionally, without a second closure structure, pouring or otherwise removing product from the package is generally unhindered.

To open the package construction of FIGS. 1, 5 or 6, first the protective hood 70 is removed by tearing along the areas of weakness 76, 78, thus providing access to the zipper closure 26 and slider device 50. This leaves a structure as shown in FIG. 9. The slider device 50 may then be moved between the stop regions adjacent to the respective end crush areas 67, 69 of the zipper closure 26 to mate and unmate the closure members 34, 44 (FIG. 2).

In some embodiments, the upper or distal flanges 35, 45 (FIG. 2) are sufficiently long enough that they can be gripped by a person's fingers. Due to the length of the flanges 35, 45, the mating closure members 34, 44 can be pulled apart. Thus, the zipper closure 26 may be unlocked even without moving the slider device 50 from the closed end.

Before the protective hood 70 is removed, it may be possible to manipulate or otherwise slide the slider device 50 between the stop regions 66, 68 adjacent to the end crush areas 67, 69 of the zipper closure 26; this can be accomplished providing a force through the walls 72, 74 (FIG. 7) of the hood 70. However, when the slider device 50 is moved in this manner, the slider device 50 remains trapped between the stop regions adjacent to end crush areas 67, 69 and does not contact the side edges 22, 24 of the package, nor is the interior 11 (FIG. 1) of the package accessible.

Figure 10:
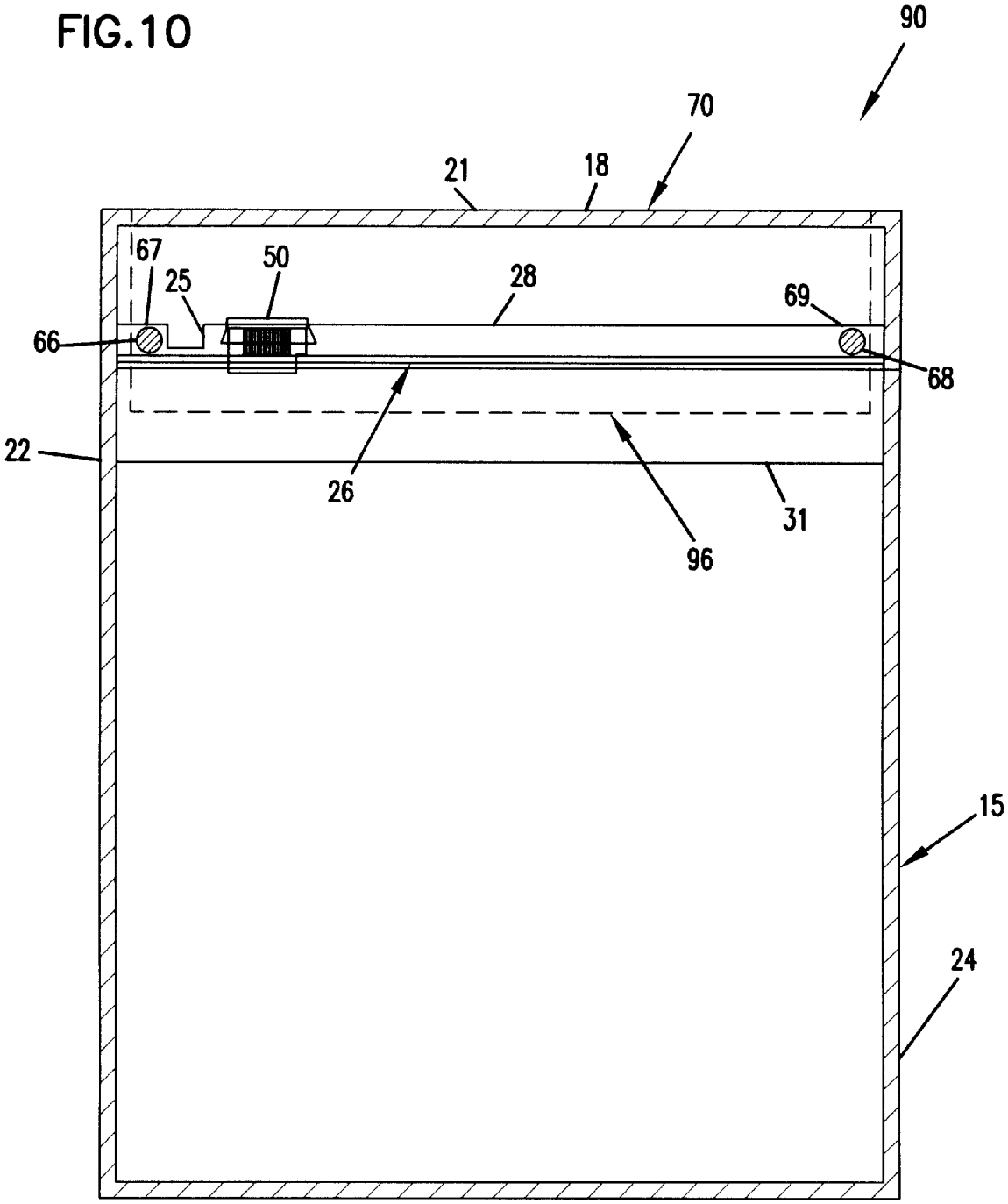
FIG. 10 is a schematic front plan view of a fourth embodiment of a reclosable package.

Yet another embodiment is illustrated in FIG. 10. Package 90 is similar to packages 10, 10", 10" of FIGS. 1, 5 and 6 except that weakness 76 of packages 10, 10', 10" is illustrated as weakness 96. Area of weakness 96, such as a perforation, tear strip, die lie, laser score line or any other weakness, is used to help facilitate the removal of the hood 70. In FIGS. 1, 5 and 6, note that the weakness 76 is located below both the slider device 50 and the zipper closure 26; in package 90 of FIG. 10, a portion of weakness 96 extends below the slider device 50 and zipper closure 26 along the length of mouth 28 between crush areas 67, 69. Additional portions of weakness 96 extend angled to mouth 28, so that they pass between first crush area 66 and first side edge 22 and between second crush area 68 and second side edge 24. In FIG. 10, a portion of weakness 96 is illustrated extending essentially perpendicular to mouth 28 and essentially parallel to side edges 22, 24.

Figure 11:
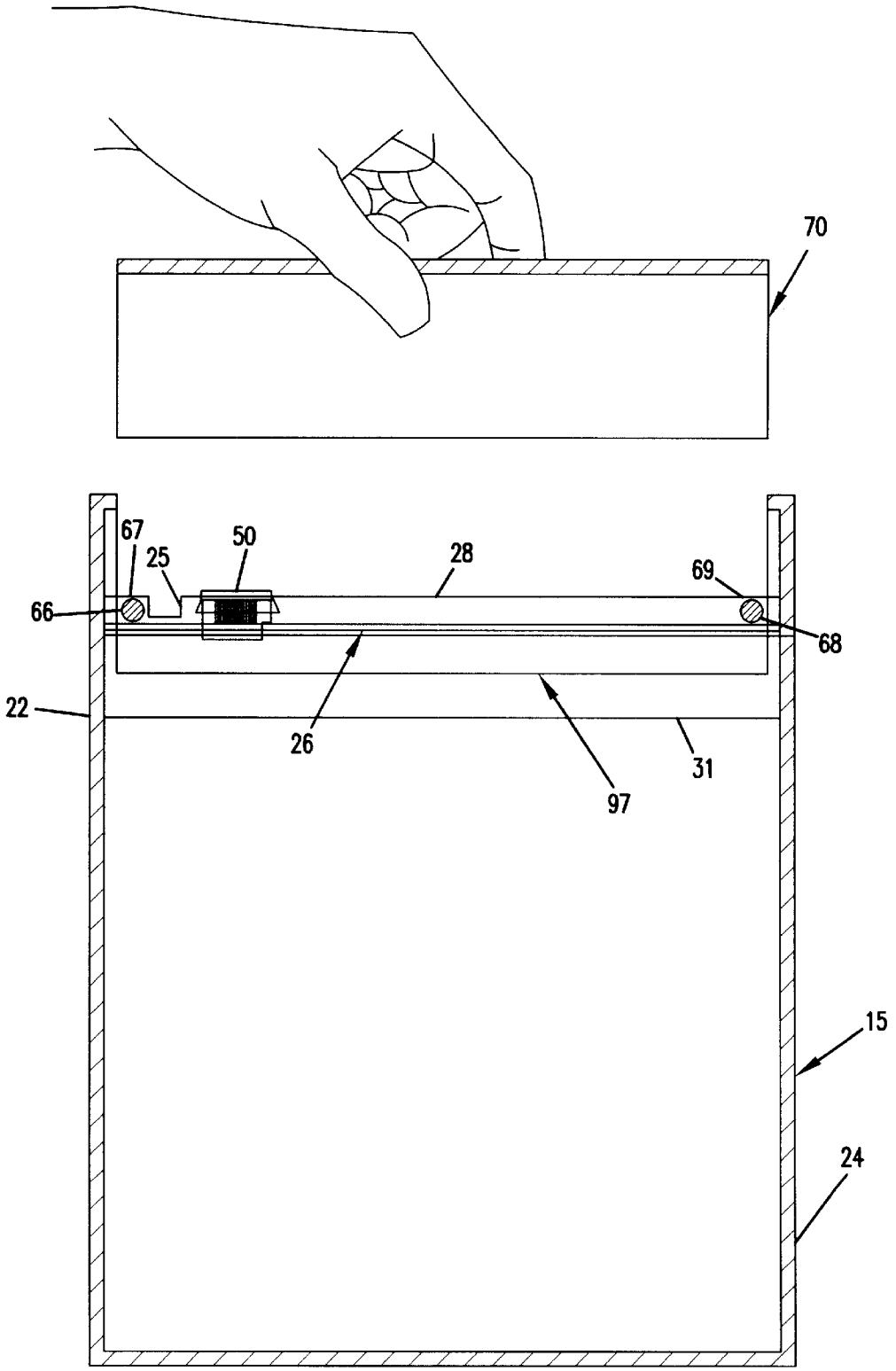
FIG. 11 is a schematic front plan view of the package of FIG. 10 with the tamper evident-structure removed.

FIG. 11 represents the package 90 of FIG. 10 with hood 70 removed from the product-containment section 15. A small fragment of material at 97 remains between the areas of weakness 96 (FIG. 10) and the profile bonding region 31. After the hood 70 (FIG. 10) is removed, the slider device 50 is exposed to permit operation by the user to open and close the zipper closure 26. Note that the fragment 97 is short enough in length that it does not interfere in any manner with the operation of the slider device 50. The fragment 97 ends at a point that is well below the bottommost package-engaging portions of the slider device 50. Among other things, this means that when the slider device 50 is operated to open and close the zipper closure 26, at the end points of the zipper closure 26, the fragment 97 in no manner engages the slider device 50 to prevent or stop motion of the slider device 50.

Figure 13:
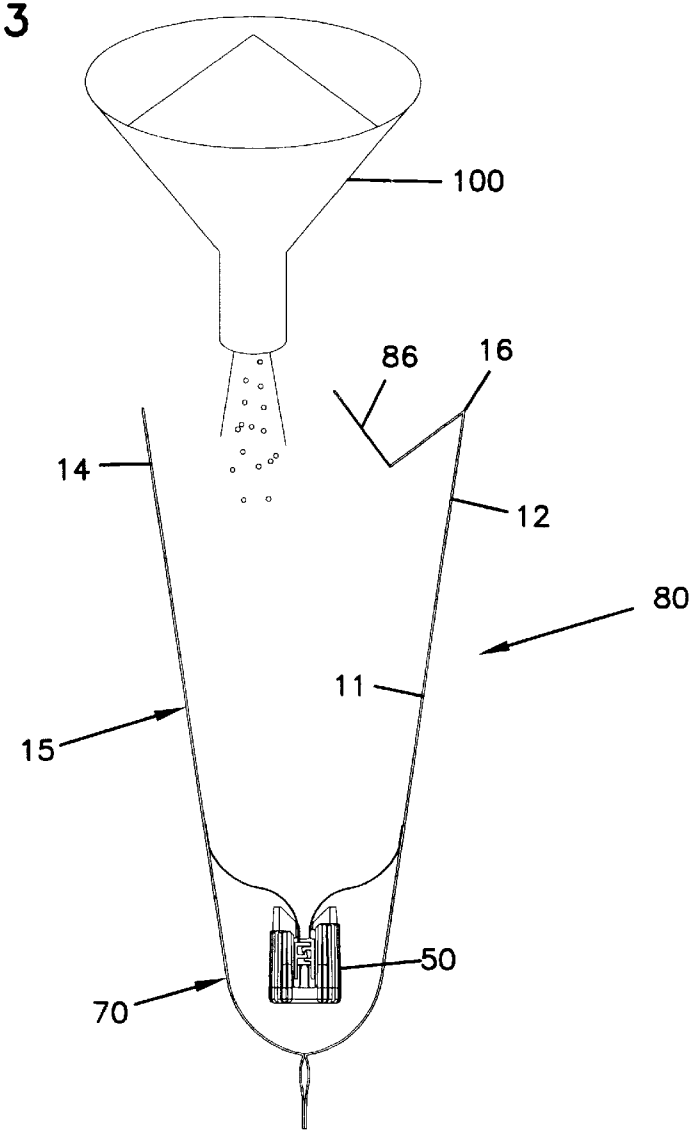
FIG. 13 is a second method for providing product in the package interior.
Figure 12:
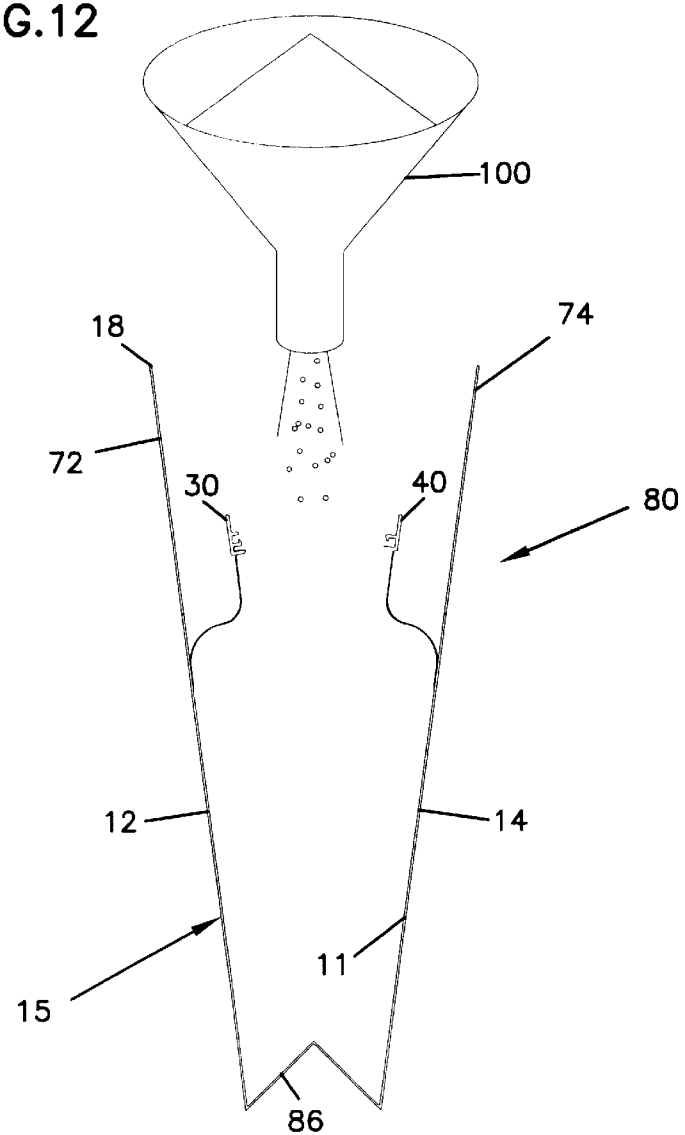
FIG. 12 is a first method for providing product in the package interior.

Attention is now directed to FIGS. 12 and 13, which show various methods for filling the various embodiments of packages. In particular, FIGS. 12 and 13 depict filling of package 80, although it is understood that any of the packages described herein can be filled by these methods.

In FIG. 12, package 80 with gusset 86 is shown being filled through top 18 with product from hopper 100. In the form shown, package 80 consists of product-containment section 15 formed by closure profiles 30, 40 bonded to panel sections 12, 14; a tamper evident-structure, such as a hood 70 (FIG. 8), is not yet present. During the filling process, closure profiles 30, 40 are not mated; rather, product is passed between these closure profiles into interior 11. After the desired product is present in interior 11, closure profiles 30, 40 are mated, a slider device 50 (FIG. 8) is mounted thereon, and a hood 70 is formed by creating top seal 21 (FIG. 8).

In FIG. 13, package 80 with gusset 86 is shown being filled through bottom 16 with product from hopper 100. In the form shown, package 80 consists of a product-containment section 15, hood 70, and a slider device 50 mounted onto zipper closure 26. During this filling process, closure profiles 30, 40 (FIG. 2) are mated and slider device 50 is mounted thereon. Bottom 16 of package 80 is not sealed so that product is passed between panel section 14 and gusset 86 into interior 11. After the desired product is present in interior 11, panel section 14 is sealed to gusset 86 to create a bottom seal.

The above specification provides a complete description of the manufacture and use of the composition of the invention. Many embodiments of the invention can be made.

We claim:

1. A reclosable package comprising:

(a) a surrounding wall defining an interior, a bottom portion, and a mouth opposite the bottom portion;

(i) the mouth having an open position and a closed position;

(A) the mouth providing access to the interior, when tie mouth is in the open position;

(ii) the surrounding wait including first and second, opposite panel sections;

(A) the first and second panel sections defining an integral hood construction; the hood construction being in covering relation to the mouth;

(B) the hood construction including a top seal region at an end of the package opposite the bottoms portion; the top seal region including the first and second panel sections being scaled along respective edge portions of the first and second panel sections;

(b) a zipper closure extending along the mouth; the zipper closure including first and second releasably interlocking closure profiles;

(i) the first and second closure profiles connected to the first and second panel sections at first and second bonding regions;

(ii) the zipper closure being covered by the hood construction; and (c) a slider device operably mounted on the zipper closure; the slider device constructed and arranged to move the mouth to the closed position by interlocking the first closure profile with the second closure profile when the slider device is moved in a first direction, and to move the mouth to the open position by disengaging the first closure profile from the second closure profile when the slider device is moved in a second opposite direction;

(i) the slider device being covered by the hood construction;

(ii) the hood construction including at least one area of weakness to provide for selective removal of the hood construction from the first and second panel sections to expose the slider device and the zipper closure;

(A) the at least one area of weakness comprises one of a perforation line, a score line, and a die line;

(B) a first portion of the at least one area of weakness extends parallel to the zipper closure;

(C) a second portion of the at least one area of weakness extends perpendicular to the zipper closure; and (D) a third portion of the at least one area of weakness extends perpendicular to the zipper closure.

2. The package according to claim 1, wherein:

(a) the at least one area of weakness is oriented between a bottommost portion of the slider device and first and second bonding regions.

3. The package according to claim 1, wherein:

(a) the at least one area of weakness is oriented essentially adjacent the zipper closure.

4. The package according to claim 1, wherein:

(a) die at least one area of weakness is oriented between the top seal region of the hood construction and a bottommost portion of the slider device.

5. The package according to claim 1, wherein:

(a) the first and second closure profiles are respectively heat sealed to the first and second panel sections at the first and second bonding regions.

6. The package according to claim 1, further comprising a bottom gusset.

7. A method of opening a package, the package comprising first and second panel sections defining an interior, a zipper closure defining a mouth having an open position and a closed position, the zipper closure having a slider device operably mounted on first and second closure profiles, and a hood construction integral with the first and second panel sections, the hood having at least one area of weakness including a first portion extending parallel to the zipper closure, a second portion extending perpendicular to the zipper closure, and a third portion extending perpendicular to the upper closure, the hood covering the zipper closure and the slider device; the method comprising:

(a) penetrating die hood by:

(i) breaching the hood at the first, second and third portions of the at least one area of weakness;

(ii) removing the hood from the surrounding wall; and (iii) exposing the slider device and the zipper closure;

(b) moving the slider device along the zipper closure to unmate the closure profiles; and (c) opening the mouth of the package to gain access to the package interior.

8. The method according to claim 7, wherein the step of breaching the hood at the first portion of the at least one area of weakness comprises:

(a) breaching the hood at a portion of an area of weakness below a bottommost portion of the slider device.

9. The method according to claim 8, wherein the step of breaching the hood at a portion of an area of weakness being below a bottommost portion of the slider device comprises:

(a) breaching the hood at a portion of an area of weakness between the bottommost portion of the slider device and a region of bonding between the first and second panel sections and the zipper closure.

* * * * *

UNITED STATES PATENT AND TRADEMARK OFFICE

CERTIFICATE OF CORRECTION

PATENT NO. : 6,467,956 B1 
DATED : October 22, 2002
INVENTOR(S) : Paul A. Tilman et al.

It is certified that error appears in the above-identified patent and that said Letters Patent is hereby corrected as shown below:

Column 10,
Line 44, “bottoms” should read -- bottom --
Line 46, “scaled” should read -- sealed --.

Column 11,
Line 24, “die” should read -- the --.

Column 12,
Line 9, “upper” should read -- zipper --.
Line 11, “die” should read -- the --.

Signed and Sealed this

Sixteenth Day of September, 2003

JAMES E. ROGAN
*Director of the United States Patent and Trademark Office*